US009516932B2

(12) United States Patent
Sohal

(10) Patent No.: US 9,516,932 B2
(45) Date of Patent: Dec. 13, 2016

(54) ARTICLES OF MANUFACTURE WITH DECORATIVE ORNAMENTATION RELATING TO CONSTELLATIONS

(71) Applicant: Jeet Sohal, Los Angeles, CA (US)

(72) Inventor: Jeet Sohal, Los Angeles, CA (US)

(73) Assignee: Inspired Design Creations, Inc., Muirfield, CA (US)

( * ) Notice: Subject to any disclaimer, the term of this patent is extended or adjusted under 35 U.S.C. 154(b) by 0 days.

(21) Appl. No.: 14/490,417

(22) Filed: Sep. 18, 2014

(65) Prior Publication Data

US 2016/0081441 A1 Mar. 24, 2016

(51) Int. Cl.
*A44C 25/00* (2006.01)
*A44C 27/00* (2006.01)

(52) U.S. Cl.
CPC ..... *A44C 25/001* (2013.01); *A44C 25/00* (2013.01); *A44C 27/00* (2013.01)

(58) Field of Classification Search
CPC ..... A44C 25/001; A44C 27/00; A44C 25/00
USPC . 368/15; 63/33, 32, 18, 12, 14.1; 29/896.41, 896.4, 896.411, 896.412
See application file for complete search history.

(56) References Cited

U.S. PATENT DOCUMENTS 2,263,582 A 11/1941 Isely
2007/0177112 A1* 8/2007 Kato ..... G03B 21/62 353/98
2013/0000353 A1* 1/2013 Lin ..... A44C 25/001 63/23
2013/0335311 A1* 12/2013 Kim ..... G06F 3/01 345/156
2015/0007609 A1* 1/2015 Zelikman ..... A44C 17/007 63/3

FOREIGN PATENT DOCUMENTS

DE 202006002043 4/2006

OTHER PUBLICATIONS

"Star power: these customized constellation pendant necklaces really shine", Cool Mom Picks [online], Oct. 24, 2012, http://coolmompicks.com/blog/2012/10/24/constellation-necklaces-julie-nolan/, pp. 3-4.

(Continued)

*Primary Examiner* — Laura Powers
(74) *Attorney, Agent, or Firm* — Klein, O'Neill & Singh, LLP

(57) ABSTRACT

An article of manufacture includes decorative ornamentation relating to constellations. More specifically, the article of manufacture bears at least a first and a second pattern of first and second elements, respectively. In the first pattern, the first elements are arranged in relative positions that correspond to relative positions of stars in a first constellation. In the second pattern, the second elements are arranged in relative positions that correspond to relative positions of stars in a second constellation. The first and second patterns are superimposed on each other, forming a decorative ornamentation that represents a composite of the first and second constellations. The patterns can be configured so that a relative size of each element corresponds to a relative brightness of the constellation star corresponding to that element.

23 Claims, 8 Drawing Sheets

(56) References Cited

OTHER PUBLICATIONS

"Zodiac Constellation Necklace", Graffiti Beach Boutique [online], May 22, 2014, http://web.archive.org/web/20140522232441/http://shopgraffitibeach.com/products/zodiacconstellationnecklace, pp. 1-2.
"The Zodiac Collection", Satya Jewelry [online], Jun. 11, 2014, http://satyajewelry.wordpress.com/2014/03/21/the-zodiac-collection/, entire document.
International Search Report from USPTO dated Oct. 30, 2015 for related International Application No. PCT/US15/42744.
Written Opinion from USPTO dated Oct. 30, 2015 for related International Application No. PCT/US15/42744.

* cited by examiner

ARTICLES OF MANUFACTURE WITH DECORATIVE ORNAMENTATION RELATING TO CONSTELLATIONS

TECHNICAL FIELD

The present embodiments relate to decorative ornamentation and, more particularly, to articles with decorative ornamentation relating to constellations.

BACKGROUND

A constellation is a pattern formed by prominent stars within apparent proximity to one another in Earth's night-time sky. The zodiac is the ring of constellations that the Sun seems to pass through each year as the Earth orbits around it. While there are actually thirteen zodiacal constellations, the following twelve constellations comprise the twelve signs of the modern zodiac: Capricorn, Aquarius, Pisces, Aries, Taurus, Gemini, Cancer, Leo, Virgo, Libra, Scorpio, and Sagittarius. Each of these twelve signs corresponds to the Gregorian dates during which the Sun passes through a sign in the Ptolemaic tropical zodiac, as shown in Table I, below.

TABLE I

| Sign | Dates |
|---|---|
| Capricorn | December 22 to January 20 |
| Aquarius | January 20 to February 18 |
| Pisces | February 18 to March 20 |
| Aries | March 20 to April 20 |
| Taurus | April 20 to May 21 |
| Gemini | May 21 to June 21 |
| Cancer | June 21 to July 23 |
| Leo | July 23 to August 23 |
| Virgo | August 23 to September 23 |
| Libra | September 23 to October 23 |
| Scorpio | October 23 to November 22 |
| Sagittarius | November 22 to December 22 |

One's date of birth determines which sign one is according to the dates in Table I, above. The twelve signs of the zodiac are used in various applications, such as astrology, which is the study of correlations of celestial events with behavior on earth.

SUMMARY

The various embodiments of the present articles of manufacture with decorative ornamentation relating to constellations have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide the advantages described herein.

In accordance with one embodiment, an article of manufacture is provided, comprising at least a first pattern of first elements and a second pattern of second elements. A relative position and a relative size of each of the first elements corresponds to a relative position and a relative magnitude of a first plurality of stars in a first constellation. A relative position and a relative size of each of the second elements corresponds to a relative position and a relative magnitude of a second plurality of stars in a second constellation. The first and second patterns of elements are superimposed upon one another.

In some such embodiments, the first and second constellations are selected from the group consisting of Aries, Taurus, Gemini, Cancer, Leo, Virgo, Libra, Scorpio, Sagittarius, Capricorn, Aquarius, and Pisces.

In additional embodiments, the article of manufacture can comprise jewelry, and in additional embodiments the jewelry can comprise a pendant.

In some embodiments each of the first and second elements comprises a decorative ornamentation.

In accordance with another embodiment, a method of making an article of manufacture is provided. The method comprises applying to the article of manufacture a first pattern of first elements and also applying a second pattern of second elements. A relative position and a relative size of each of the first elements corresponds to a relative position and a relative magnitude of a first plurality of stars in a first constellation. A relative position and a relative size of each of the second elements corresponds to a relative position and a relative magnitude of a second plurality of stars in a second constellation. The first and second elements are superimposed upon one another.

In some embodiments the first and second elements are applied to the article of manufacture consecutively. In other embodiments the first and second elements are applied to the article of manufacture simultaneously.

In additional embodiments the first and second constellations are selected from the group consisting of Aries, Taurus, Gemini, Cancer, Leo, Virgo, Libra, Scorpio, Sagittarius, Capricorn, Aquarius, and Pisces.

In some embodiments the article of manufacture comprises jewelry, and in further embodiments the jewelry can comprise a pendant.

In some embodiments each of the first and second elements comprises a decorative ornamentation.

In accordance with another embodiment, an article of manufacture is provided. The article of manufacture comprises at least a first pattern of first elements and a second patter of second elements. A relative position of each of the first elements corresponds to a relative position of a first plurality of stars in a first constellation, and a relative position of each of the second elements corresponds to a relative position of a second plurality of stars in a second constellation. The first and second patterns of elements are superimposed upon one another.

In some embodiments a relative size of each of the first elements corresponds to a relative magnitude of the first plurality of stars in the first constellation. In additional embodiments a relative size of each of the second elements corresponds to a relative magnitude of the second plurality of stars in the second constellation.

In further embodiments the first and second constellations are selected from the group consisting of Aries, Taurus, Gemini, Cancer, Leo, Virgo, Libra, Scorpio, Sagittarius, Capricorn, Aquarius, and Pisces.

In yet further embodiments the article of manufacture comprises jewelry, and in some such embodiments the jewelry comprises a pendant.

In still further embodiments each of the first and second elements comprises a decorative ornamentation.

BRIEF DESCRIPTION OF THE DRAWINGS

The various embodiments of the present articles of manufacture with decorative ornamentation relating to constellations now will be discussed in detail with an emphasis on highlighting the advantageous features. These embodiments depict the novel and non-obvious articles of manufacture with decorative ornamentation shown in the accompanying drawings, which are for illustrative purposes only. These drawings are not necessarily drawn to scale, and they are provided merely to illustrate the present embodiments. These drawings include the following figures, in which like numerals indicate like parts.

DETAILED DESCRIPTION

Figure 1:
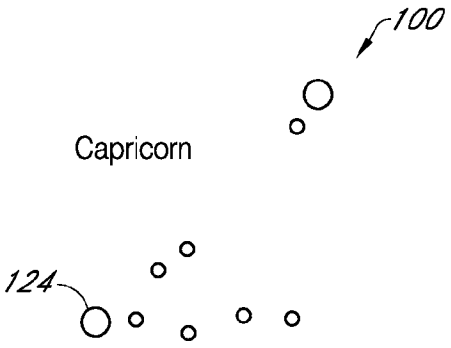
FIGS. 1-12 are schematic diagrams of the constellations Capricorn, Aquarius, Pisces, Aries, Taurus, Gemini, Cancer, Virgo, Leo, Libra, Scorpio, and Sagittarius, respectively.

The following detailed description describes the present embodiments with reference to the drawings. In the drawings, reference numbers label elements of the present embodiments. These reference numbers are reproduced below in connection with the discussion of the corresponding drawing features.

In the present embodiments, and as further described below, two or more constellations are applied to an article of manufacture with the constellations overlaid or superimposed upon one another. By superimposing two or more constellations on a single article of manufacture, various "family constellations" can be created in which the zodiacal signs of two or more persons in a family are combined to create a composite constellation. The present family constellations can be represented on a wide variety of articles of manufacture, such as jewelry, clothing, accessories, and/or home objects and the like.

In some embodiments, and as further described below, two or more superimposed constellations may be represented on an article of manufacture with the constellations oriented according to a first relative rotational orientation. In other embodiments, and as further described below, two or more superimposed constellations may be represented on an article of manufacture with at least one of the constellations rotated by any desired angle of rotation with respect to at least one other of the superimposed constellations. In yet further embodiments, and as further described below, two or more superimposed constellations may be represented on an article of manufacture with at least one of the constellations shifted laterally by any desired distance with respect to at least one other of the superimposed constellations. In still further embodiments, and as further described below, two or more superimposed constellations may be represented on an article of manufacture with at least one of the constellations rotated by any desired angle of rotation and shifted laterally by any desired distance with respect to at least one other of the superimposed constellations. As used herein, the terms lateral, lateral shift, and the like, are to be interpreted broadly to include a shift in any direction, whether up, down, to either side, or any combination of up, down, and/or to either side.

Figure 2:
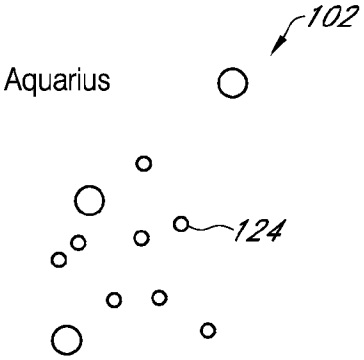
Figure 3:
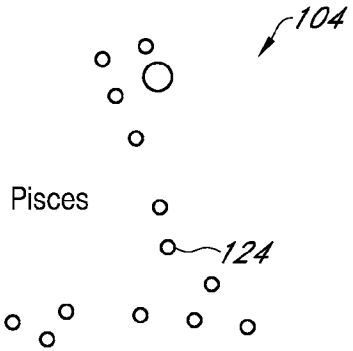
Figure 4:
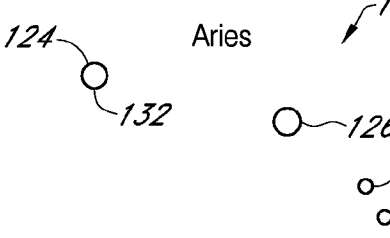
Figure 5:
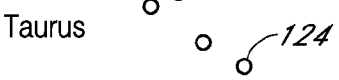
Figure 6:
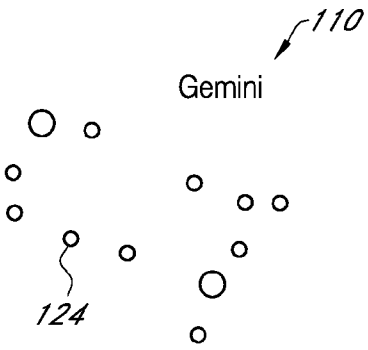
Figure 8:
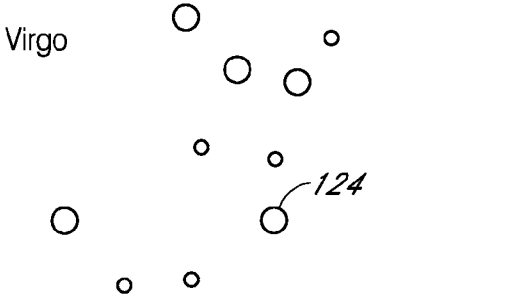
Figure 9:
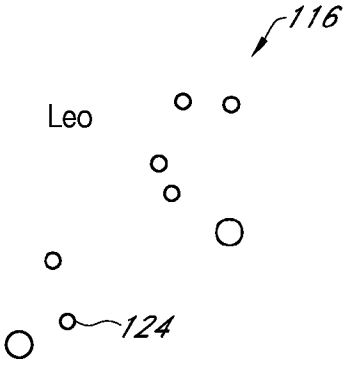
Figure 7:
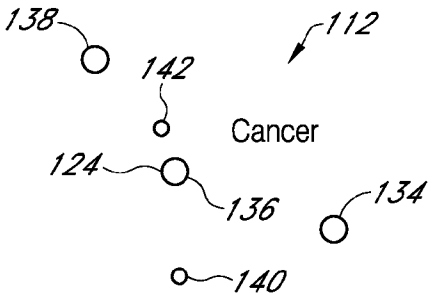
Figure 11:
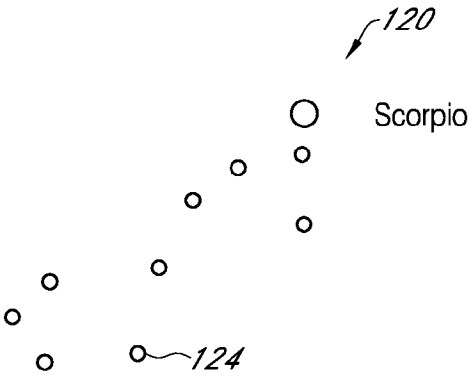
Figure 12:
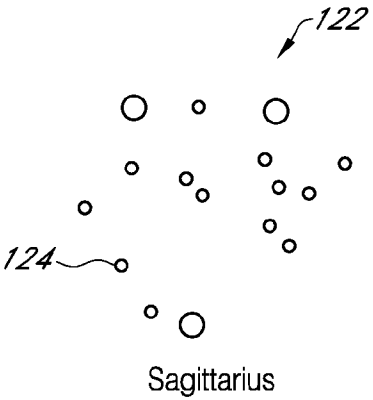
Figure 10:
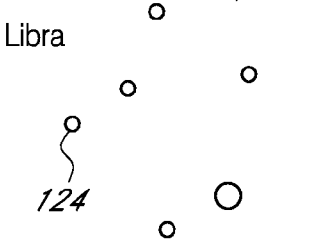

FIGS. 1-12 illustrate the twelve constellations that comprise the twelve signs of the modern zodiac. More particularly, FIG. 1 illustrates Capricorn 100, FIG. 2 illustrates Aquarius 102, FIG. 3 illustrates Pisces 104, FIG. 4 illustrates Aries 106, FIG. 5 illustrates Taurus 108, FIG. 6 illustrates Gemini 110, FIG. 7 illustrates Cancer 112, FIG. 8 illustrates Virgo 114, FIG. 9 illustrates Leo 116, FIG. 10 illustrates Libra 118, FIG. 11 illustrates Scorpio 120, and FIG. 12 illustrates Sagittarius 122.

Each of the constellations illustrated in FIGS. 1-12 comprises a plurality of stars, and the stars are represented in the figures by elements 124 (shown as circles). In some of the present embodiments, the position of each star in each constellation relative to the other stars in the same constellation may be represented by the position of each element 124 relative to the position of the other elements 124 in the same figure. For example, with reference to FIG. 4, the constellation Aries 106 comprises four main stars: Hamal (Alpha Arietis) 126, Sheratan (Beta Arietis) 128, Mesarthim (Gamma Arietis) 130, and Botein (Delta Arietis) 132. In FIG. 4, these four stars 126, 128, 130, 132 have the same relative positions as the actual stars in Earth's nighttime sky.

Also in some of the present embodiments, the apparent magnitude of each star in each constellation relative to the other stars in the same constellation may be represented by the size of each element 124 relative to the size of the other elements 124 in the same figure. The apparent magnitude of a star is a measure of its brightness as seen by an observer on Earth. For example, with reference to FIG. 7, the constellation Cancer 112 comprises five main stars. These stars are, in order of decreasing brightness: Beta Cancri 134, Delta Cancri 136, Iota Cancri 138, Alpha Cancri 140, and Gamma Cancri 142.

In further embodiments, both the position and the apparent magnitude of each star in each constellation relative to the other stars in the same constellation may be represented by the position and the size, respectively, of each element 124 relative to the position and the size, respectively, of the other elements 124 in the same figure. An example of such an embodiment is shown in FIG. 7, which is described above. In still further embodiments, the size of each element 124 relative to the other elements 124 in the same figure may bear no relation to the relative apparent magnitudes of each star in each constellation. For example, with reference to FIG. 4, the constellation Aries 106 comprises four main stars: Hamal (Alpha Arietis) 126, Sheratan (Beta Arietis)

128, Mesarthim (Gamma Arietis) 130, and Botein (Delta Arietis) 132. In FIG. 4, Hamal (Alpha Arietis) 126 and Botein (Delta Arietis) 132 are represented with the largest elements 124, even though Botein (Delta Arietis) is the dimmest of the four main stars in the constellation Aries. Likewise, Sheratan (Beta Arietis) 128 is represented with a relatively small element 124, even though Sheratan (Beta Arietis) is the second brightest star in the constellation Aries.

In alternative embodiments, all the stars in a given constellation may be represented on an article of manufacture by making all the elements 124 on that article of manufacture the same size. Likewise, all the stars in a given combination of superimposed or overlaid constellations may be represented on an article of manufacture by making all the elements 124 on that article of manufacture the same size.

In the present embodiments, the constellations of FIGS. 1-12 may be represented with elements 124 applied to or formed in or on various articles of manufacture. As used herein, the term element 124 is to be construed broadly to include any type of surface feature or ornamentation. For example, elements 124 may include, but are not limited to, through holes, indentations, raised relief or "bumps," objects secured to a surface, objects embedded within a surface, etc.

Figure 13:
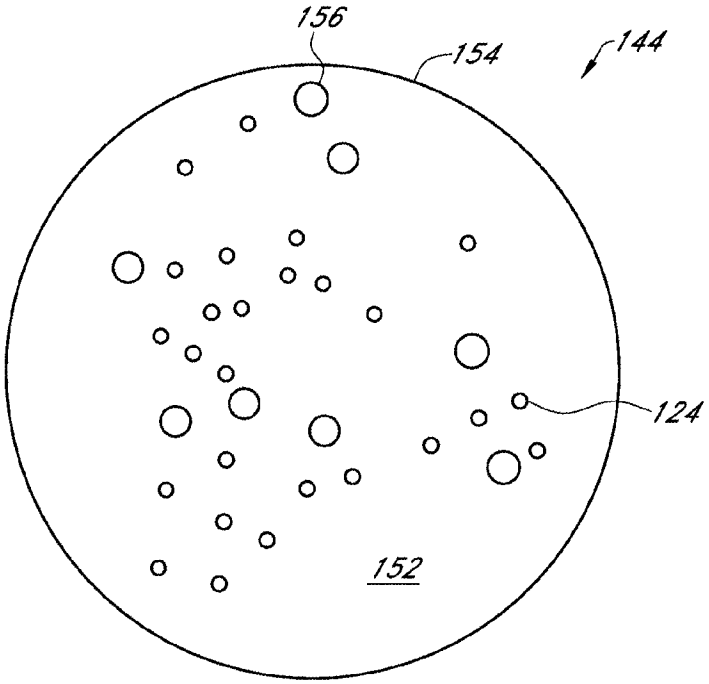
FIG. 13 is a front elevation view of an article of jewelry including three superimposed constellations: Virgo, Taurus, and Pisces.
Figure 13A:
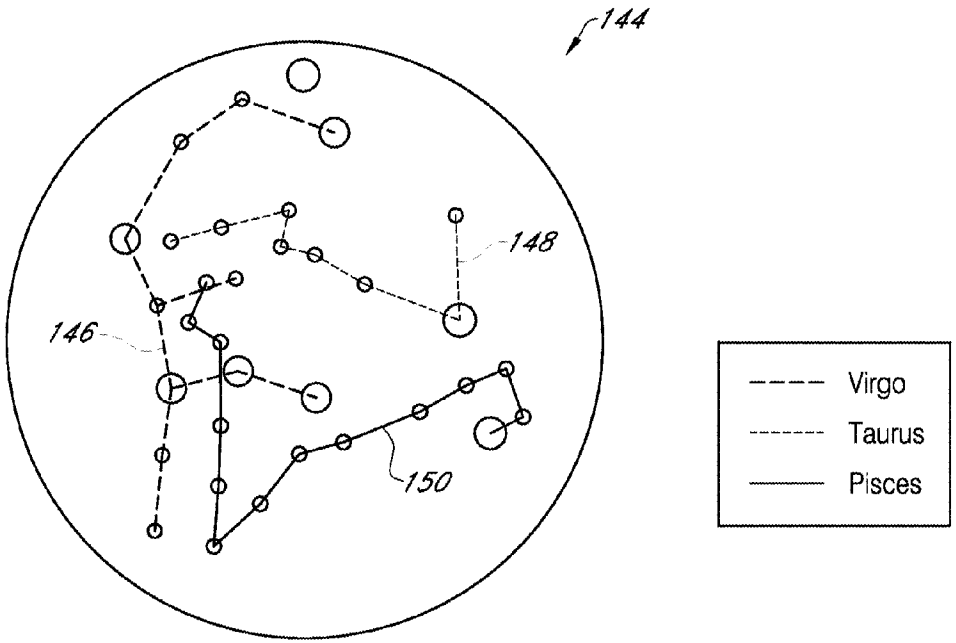
FIG. 13A is a front elevation view of the article of jewelry of FIG. 13 including lines of contrasting patterns connecting the stars in each constellation.
Figure 14:
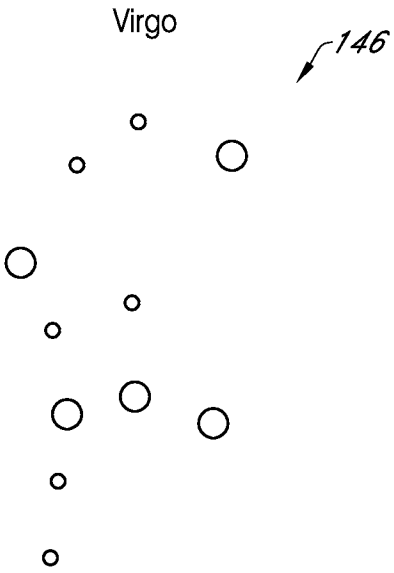
FIGS. 14-16 are schematic diagrams of the constellations Virgo, Taurus, and Pisces.
Figure 15:
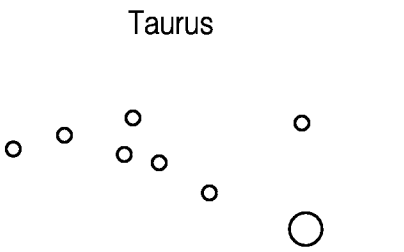
Figure 16:
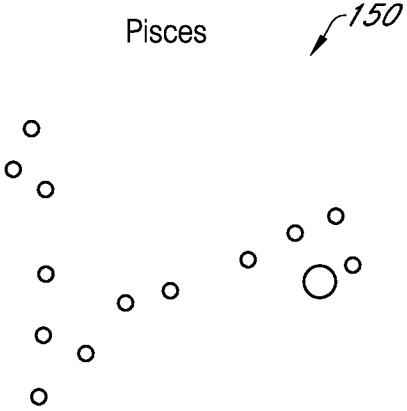

In the present embodiments, two or more constellations are represented on an article of manufacture with the constellations superimposed upon one another. For example, FIG. 13 illustrates an article of jewelry, in this case a pendant 144, including three superimposed constellations: Virgo 146, Taurus 148, and Pisces 150. For comparison, FIGS. 14-16 illustrate the individual constellations Virgo 146, Taurus 148, and Pisces 150, respectively, and FIG. 13A illustrates the positioning of each constellation relative to the other constellations by connecting the stars in each constellation with lines of contrasting patterns. By superimposing two or more constellations on a single article of manufacture, various "family constellations" can be created in which the zodiacal signs of two or more members of a family are combined to create a composite constellation.

With reference to FIG. 13, the pendant 144 includes a body portion 152 having a peripheral edge 154. An aperture 156 near the peripheral edge 154 provides an opening through which a chain, cord, lanyard, string, twine, etc. may be threaded so that the pendant 144 can be worn about the neck of a wearer. The stars in the family constellation are represented with a plurality of elements 124 arranged about the body portion 152. In the illustrated embodiment, the elements 124 comprise through holes formed in the body portion 152. In some embodiments, a size of each through hole may correspond to the brightness of the star that each through hole represents in its respective constellation (relative to the other stars in the same constellation) in Earth's nighttime sky, with brighter stars being represented by through holes having larger diameters.

In some embodiments, two or more superimposed constellations may be represented on an article of manufacture with the constellations oriented according to a first relative rotational orientation. For example, with reference to FIGS. 13A and 14-16, the three constellations of FIGS. 14-16 (Virgo 146, Taurus 148, Pisces 150) are superimposed on the pendant 144 of FIG. 13 without rotating any of the constellations from the orientation of each shown in FIGS. 14-16. However, it may be advantageous in certain embodiments to rotate and/or laterally shift at least one of the constellations in a composite constellation. For example, when superimposing multiple constellations, a relative position and/or rotational orientation of the constellations may result in at least one star from a first one of the constellations overlapping with at least one star from a second one of the constellations. In such a situation, a lateral shift and/or rotation of at least one of the constellations may eliminate the overlap and produce a composite constellation that is more aesthetically pleasing. This concept is described below with reference to FIGS. 17A-17C, 18A-18C, 19, and 20.

Figure 17C:
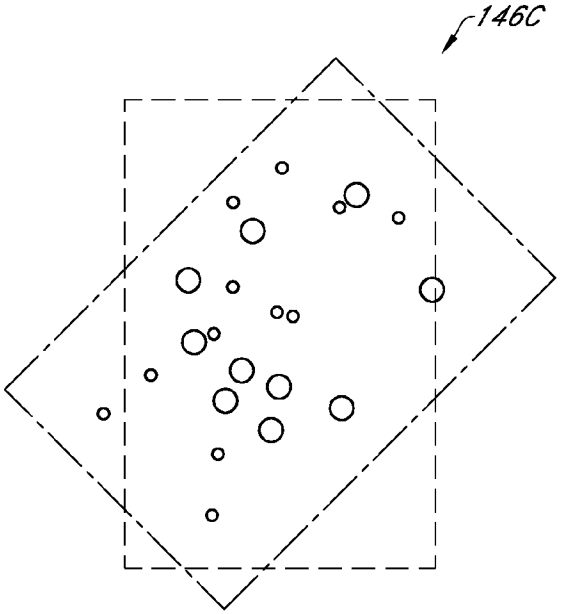
FIG. 17C is a schematic diagram showing FIGS. 17A and 17B superimposed upon one another.
Figure 17B:
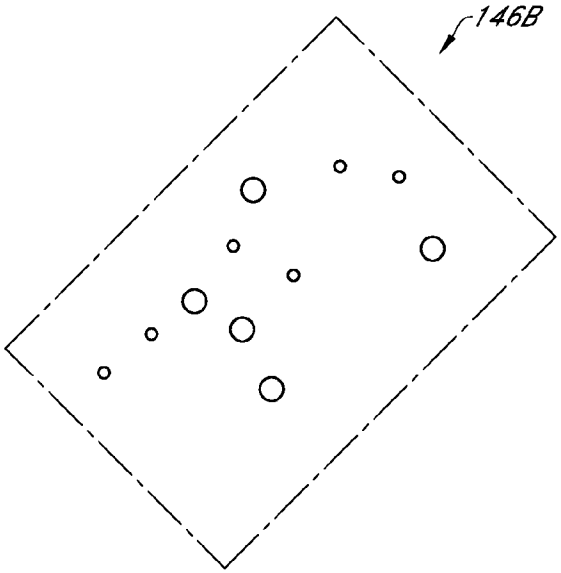
FIG. 17B is a schematic diagram of the constellation Virgo in a second rotational orientation, rotated approximately 45° clockwise with respect to the first rotational orientation of FIG. 17A.
Figure 17A:
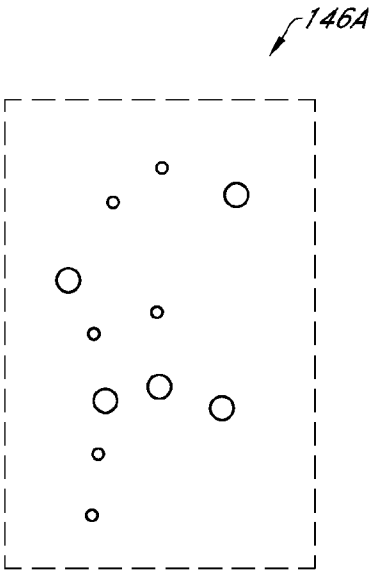
FIG. 17A is a schematic diagram of the constellation Virgo in a first rotational orientation.

With reference to FIGS. 17A-17C, FIG. 17A illustrates a first instance of the constellation Virgo 146A in the same rotational orientation as shown in FIG. 14. FIG. 17B illustrates a second instance of the constellation Virgo 146B rotated clockwise by approximately 45° from the rotational orientation shown in FIG. 17A. In FIG. 17C, the first and second constellations 146A, 146B of FIGS. 17A and 17B, respectively, are superimposed to produce a composite constellation 146C with no overlap of stars between the first and second constellations 146A, 146B.

Figure 18C:
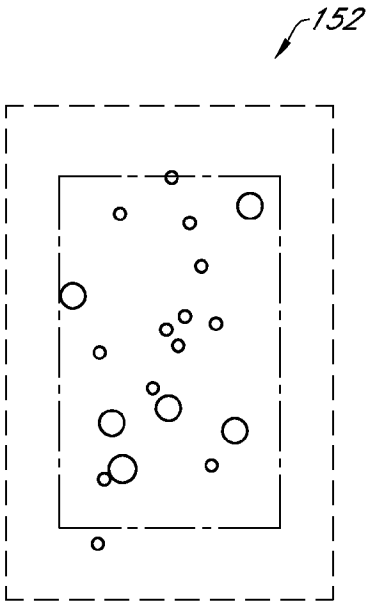
FIG. 18C is a schematic diagram showing FIGS. 18A and 18B superimposed upon one another.
Figure 18B:
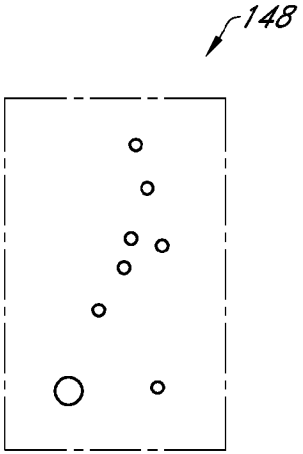
FIG. 18B is a schematic diagram of the constellation Taurus in a rotational orientation that is rotated approximately 90° clockwise with respect to the rotational orientation shown in FIG. 15.
Figure 18A:
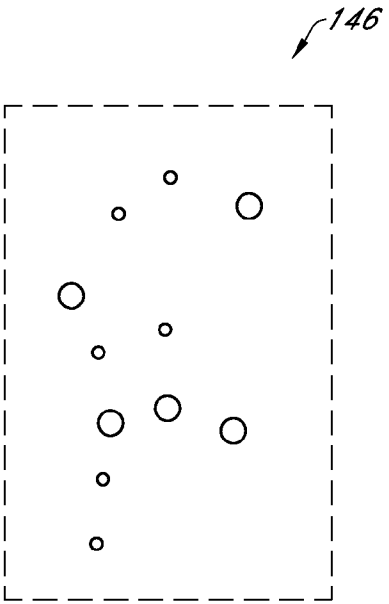
FIG. 18A is a schematic diagram of the constellation Virgo in the same rotational orientation as shown in FIG. 14.

Rotating and/or shifting at least one of the constellations in a composite constellation is not limited to situations involving more than one instance of the same constellation, as in the example of FIGS. 17A-17C. This concept can also be applied when two or more different constellations are superimposed. For example, with reference to FIGS. 18A-18C, FIG. 18A illustrates the constellation Virgo 146 in the same rotational orientation as shown in FIG. 14. FIG. 18B illustrates the constellation Taurus 148 rotated clockwise by approximately 90° from the rotational orientation shown in FIG. 15. In FIG. 18C, the constellations 146, 148 of FIGS. 18A and 18B are superimposed to produce a composite constellation 152 with no overlap of stars between the constellations 146, 148.

Figure 19:
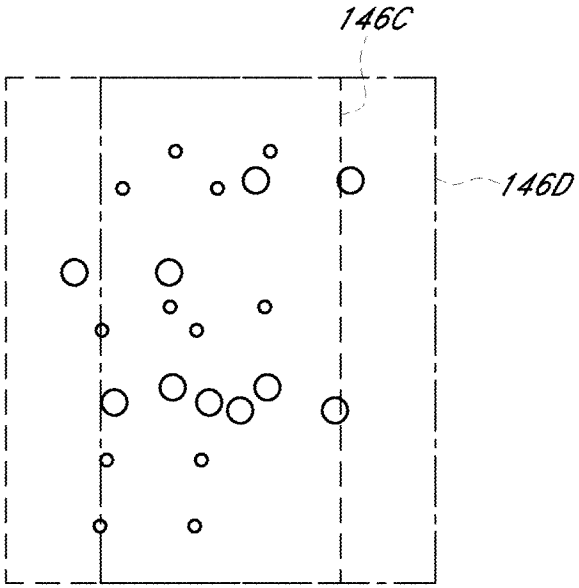
FIG. 19 is a schematic diagram of two instances of the constellation Virgo superimposed upon one another, with one of the constellations shifted laterally with respect to the other.

FIG. 19 illustrates an example of two superimposed constellations with one of the constellations shifted with respect to the other constellation. In FIG. 19, two instances of the constellation Virgo 146C, 146D are superimposed. Each instance is indicated by the broken line box drawn around each, with two different broken line patterns shown to differentiate the first and second instances 146C, 146D of the constellation Virgo. The second instance 146D is shifted to the right with respect to the first instance 146C. While in the example of FIG. 19 one of the instances of the constellation Virgo is shifted in only one direction (to the right), in other embodiments a lateral shift of one or more constellations may include a lateral shift in multiple directions, such as a shift to the right or left coupled with a shift up or down.

Figure 20:
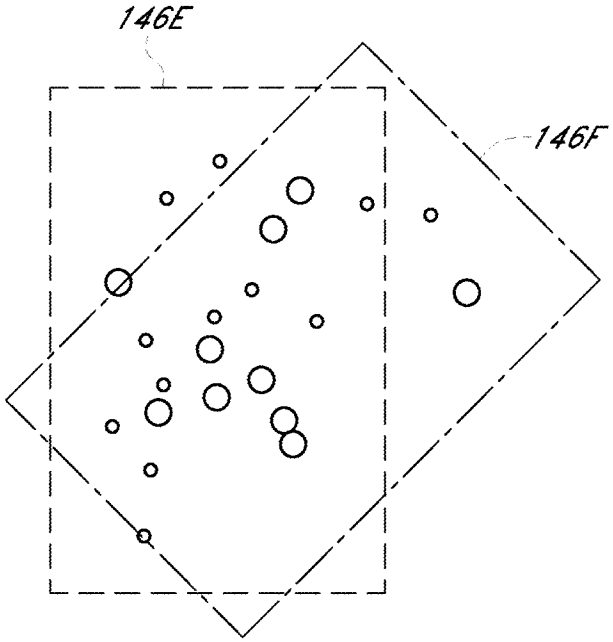
FIG. 20 is a schematic diagram of two instances of the constellation Virgo superimposed upon one another, with one of the constellations shifted laterally and rotated approximately 45° clockwise with respect to the other.

FIG. 20 illustrates an example of two superimposed constellations with one of the constellations rotated and shifted with respect to the other constellation. In FIG. 20, two instances of the constellation Virgo 146E, 146F are superimposed. Each instance is indicated by the broken line box drawn around each, with two different broken line patterns shown to differentiate the first and second instances of the constellation Virgo. The second instance 146F is rotated and shifted to the right with respect to the first instance 146E.

The pendant 144 shown in FIG. 13 is merely one non-limiting example of an article of manufacture on which the family constellations of the present embodiments can be represented. Additional examples of articles of manufacture on which the family constellations of the present embodiments can be formed include, but are not limited to, jewelry, such as pendants, earrings, rings, cuffs, bracelets, charms, etc., clothing, such as blouses, tanks, t-shirts, sweaters, underwear, outerwear, hats, scarves, etc., accessories, such as tote bags, hand bags, clutches, purses, pouches, cell phone cases, laptop cases, etc., home products, such as rugs, fireplace screens, plaques, plates, mugs, cups, dinnerware, napkins, blankets, bedding, pillows, serving trays, book ends, coffee tables, etc.

The through holes in the pendant 144 of FIG. 13 are also just one non-limiting example of elements 124 that can be formed in, formed on, or applied to an article of manufacture to represent stars in a constellation or combination of constellations. The present embodiments are not limited to any type or kind of element 124 or decorative ornamentation. Examples of decorative ornamentations that can be used to represent the stars in various constellations include, but are not limited to, objects such as gemstones, stones, beads, etc. Further examples include, but are not limited to, through holes, indentations, depressions, scores, marks, dots, embroidery, etc. Elements 124 such as marks and dots can be produced in any manner, such as by application of inks, dyes, pigments, paints, etc., and/or using any process, such as printing, etc.

The combination of three superimposed constellations (Virgo 146, Taurus 148, and Pisces 150) in the pendant 144 of FIG. 13 is also just one non-limiting example. The present embodiments include all possible combinations of the twelve zodiacal constellations, including all 66 possible combinations of two selected ones of the twelve zodiacal constellations, all 220 possible combinations of three selected ones of the twelve zodiacal constellations, all 495 possible combinations of four selected ones of the twelve zodiacal constellations, all 792 possible combinations of five selected ones of the twelve zodiacal constellations, all 924 possible combinations of six selected ones of the twelve zodiacal constellations, all 792 possible combinations of seven selected ones of the twelve zodiacal constellations, all 495 possible combinations of eight selected ones of the twelve zodiacal constellations, all 220 possible combinations of nine selected ones of the twelve zodiacal constellations, all 66 possible combinations of ten selected ones of the twelve zodiacal constellations, all 12 possible combinations of eleven selected ones of the twelve zodiacal constellations, and the one possible combination of all twelve zodiacal constellations.

Further, some embodiments may comprise constellations other than the twelve zodiacal constellations, such as constellations that are not signs of the modern zodiac. Such constellations are too numerous to list. Nevertheless, it is to be understood that the present embodiments are not restricted to the twelve constellations that comprise the twelve signs of the modern zodiac.

The present embodiments further include methods of making various articles of manufacture including elements that represent constellations. For example, a method of making an article of manufacture may comprise applying to the article of manufacture a first pattern of first elements, such as decorative ornamentation. A relative position and a relative size of each of the first elements corresponds to a relative position and a relative magnitude of a first plurality of stars in a first constellation. The method may further comprise applying to the article of manufacture a second pattern of second elements, such as decorative ornamentation, wherein the first and second elements are superimposed upon one another. A relative position and a relative size of each of the second elements corresponds to a relative position and a relative magnitude of a second plurality of stars in a second constellation. In some embodiments, the first and second elements may be applied to the article of manufacture consecutively. In other embodiments, the first and second elements may be applied to the article of manufacture simultaneously. In some embodiments, the article of manufacture comprises jewelry, such as a pendant.

The above description presents various embodiments of the present invention, and the manner and process of making and using them, in such full, clear, concise, and exact terms as to enable any person skilled in the art to which it pertains to make and use this invention. This invention is, however, susceptible to modifications and alternate constructions from that discussed above that are fully equivalent. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention.

What is claimed is:

1. An article of manufacture, comprising:

at least a first pattern of first elements, wherein a relative position and a relative size of each of the first elements corresponds to a relative position and a relative magnitude of a first plurality of stars in a first constellation; and at least a second pattern of second elements, wherein a relative position and a relative size of each of the second elements corresponds to a relative position and a relative magnitude of a second plurality of stars in a second constellation;

wherein the first pattern of first elements and the second pattern of second elements are superimposed upon one another and simultaneously visible on one surface of the article of manufacture.

2. The article of manufacture of claim 1, wherein the first and second constellations are selected from the group consisting of Aries, Taurus, Gemini, Cancer, Leo, Virgo, Libra, Scorpio, Sagittarius, Capricorn, Aquarius, and Pisces.

3. The article of manufacture of claim 1, wherein the article of manufacture comprises jewelry.

4. The article of manufacture of claim 3, wherein the jewelry comprises a pendant.

5. The article of manufacture of claim 1, wherein each of the first and second elements comprises a decorative ornamentation.

6. A method of making an article of manufacture, the method comprising:

applying to a surface of the article of manufacture a first pattern of first elements, wherein a relative position and a relative size of each of the first elements corresponds to a relative position and a relative magnitude of a first plurality of stars in a first constellation that is visible in the nighttime sky; and applying to the surface of the article of manufacture a second pattern of second elements, wherein a relative position and a relative size of each of the second elements corresponds to a relative position and a relative magnitude of a second plurality of stars in a second constellation that is visible in the nighttime sky and which does not overlap the first constellation as viewed in the nighttime sky;

wherein the first pattern of first elements and the second pattern of second elements are superimposed upon one another on the surface of the article of manufacture.

7. The method of claim 6, wherein the first and second elements are applied to the article of manufacture consecutively.

8. The method of claim 6, wherein the first and second elements are applied to the article of manufacture simultaneously.

9. The method of claim 6, wherein the first and second constellations are selected from the group consisting of Aries, Taurus, Gemini, Cancer, Leo, Virgo, Libra, Scorpio, Sagittarius, Capricorn, Aquarius, and Pisces.

10. The method of claim 6, wherein the article of manufacture comprises jewelry.

11. The method of claim 10, wherein the jewelry comprises a pendant.

12. The method of claim 6, wherein each of the first and second elements comprises a decorative ornamentation, and the first and second elements are applied to the article of manufacture so as to be simultaneously visible.

13. An article of manufacture, comprising:

at least a first pattern of first elements, wherein a relative position of each of the first elements corresponds to a relative position of a first plurality of stars in a first constellation as visible in the nighttime sky; and at least a second pattern of second elements, wherein a relative position of each of the second elements corresponds to a relative position of a second plurality of stars in a second constellation as visible in the nighttime sky; and wherein the first pattern of first elements and the second pattern of second elements are superimposed upon one another and simultaneously visible, defining a composite pattern, wherein the composite pattern visually represents the first and second constellations superimposed upon one another forming a composite constellation on the article of manufacture.

14. The article of manufacture of claim 13, wherein a relative size of each of the first elements corresponds to a relative magnitude of the first plurality of stars in the first constellation.

15. The article of manufacture of claim 14, wherein a relative size of each of the second elements corresponds to a relative magnitude of the second plurality of stars in the second constellation.

16. The article of manufacture of claim 13, wherein the first and second constellations are selected from the group consisting of Aries, Taurus, Gemini, Cancer, Leo, Virgo, Libra, Scorpio, Sagittarius, Capricorn, Aquarius, and Pisces.

17. The article of manufacture of claim 13, wherein the article of manufacture comprises jewelry, and the composite pattern is formed upon a single jewelry piece.

18. The article of manufacture of claim 17, wherein the jewelry comprises a pendant.

19. The article of manufacture of claim 13, wherein each of the first and second elements comprises a decorative ornamentation.

20. The article of manufacture of claim 1, wherein the first pattern has a first pattern axis and the second pattern has a second pattern axis, the first and second patterns being superimposed upon one another so that the first pattern axis is aligned with the second pattern axis.

21. The article of manufacture of claim 20, wherein the first pattern is rotationally shifted relative to the second pattern about the aligned first and second pattern axes.

22. The article of manufacture of claim 21, wherein the first elements of the first pattern do not overlap with the second elements of the second pattern.

23. The article of manufacture of claim 1, wherein the first pattern has a first pattern axis and the second pattern has a second pattern axis, and the first and second patterns are superimposed upon one another so that the first pattern axis is laterally spaced from the second pattern axis.

* * * * *